United States Patent [19]

Pettit

[11] Patent Number: 4,600,348

[45] Date of Patent: Jul. 15, 1986

[54] PANEL HOIST

[76] Inventor: Earl O. Pettit, P.O. Box 1271, Priest River, Id. 83856

[21] Appl. No.: 629,118

[22] Filed: Jul. 9, 1984

[51] Int. Cl.[4] ..... E04G 21/14

[52] U.S. Cl. ..... 414/11; 52/121; 52/632; 254/3 C; 254/4 C

[58] Field of Search ..... 414/10, 11; 254/3 R, 254/3 C, 4 R, 4 C, 6 C, 7 C, 47; 187/9 E, 27; 52/121, 632

[56] References Cited

U.S. PATENT DOCUMENTS

| | | | |
|---|---|---|---|
| 2,442,349 | 6/1948 | Foster . | |
| 2,472,887 | 6/1949 | Core . | |
| 2,672,319 | 3/1954 | Nelson | 414/10 |
| 2,815,251 | 12/1957 | Stone . | |
| 2,964,293 | 12/1960 | Foth | 414/11 X |
| 2,966,993 | 1/1961 | Cooper | 414/11 |
| 2,969,220 | 1/1961 | Spencer . | |
| 2,983,474 | 5/1961 | Hanna | 254/4 C X |
| 3,178,038 | 4/1965 | Love | 414/11 |
| 3,221,900 | 12/1965 | Love . | |
| 3,305,219 | 2/1967 | Rhodes | 414/11 |
| 3,382,988 | 5/1968 | O'Reilly | 414/11 |
| 3,467,261 | 9/1969 | Jewell | 414/11 |
| 3,861,647 | 1/1975 | Meredith | 254/4 R |
| 3,891,184 | 6/1975 | Fields | 254/4 R |
| 4,120,484 | 10/1978 | Zimmer | 254/6 C |
| 4,300,751 | 11/1981 | Delaney | 414/11 X |
| 4,339,219 | 7/1982 | Lay | 414/11 |

FOREIGN PATENT DOCUMENTS

| | | | |
|---|---|---|---|
| 1016264 | 1/1966 | United Kingdom | 52/121 |

*Primary Examiner*—Leslie J. Paperner

*Attorney, Agent, or Firm*—Wells, St. John & Roberts

[57] ABSTRACT

A panel hoist for raising sheet or panel materials such as sheet rock, plywood, rock lath and similar materials. The panel hoist is used to aid in installation of these panels, particularly when the installer is working singlehandedly. The panel hoist includes a telescoping mast assembly, preferably having three stage operation. A collapsible base framework is provided with casters so that the panel hoist can be rolled into position. The collapsible base framework is specially constructed so as to minimize the size of the unit in the collapsed. Two different head assemblies are provided, depending upon whether panels are being installed horizontally or upright. The head assemblies are also collapsible to provide compactness and easy portability.

8 Claims, 7 Drawing Figures

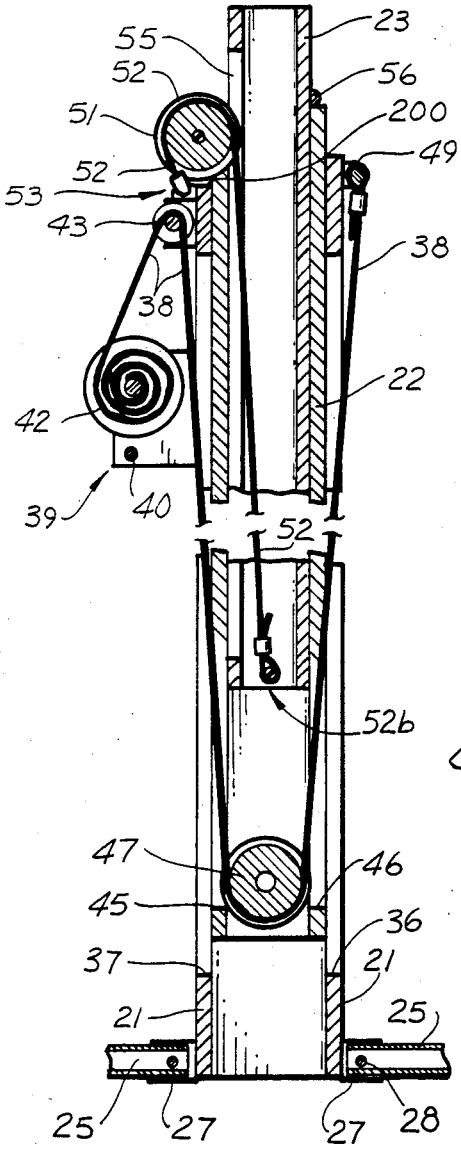
FIG 2
FIG 3
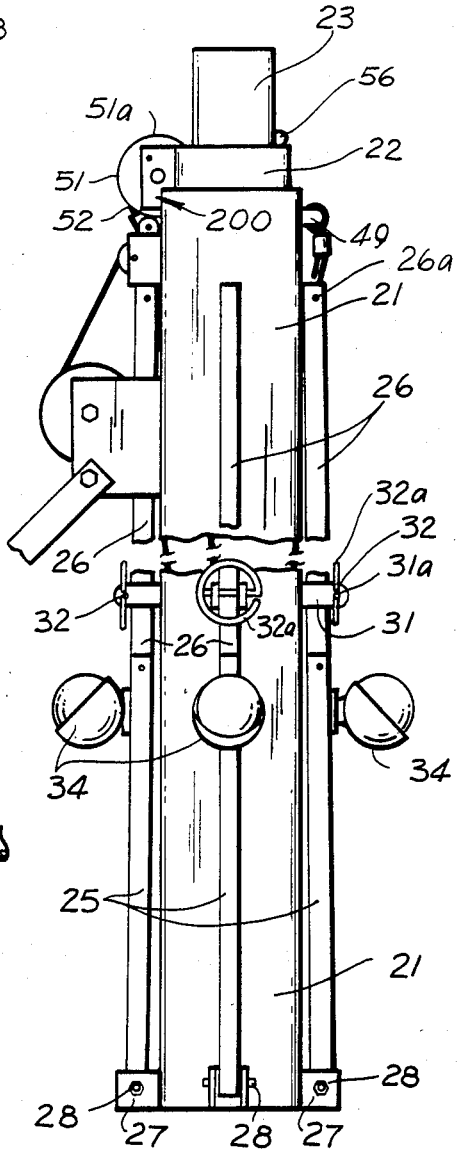

PANEL HOIST

TECHNICAL FIELD OF THE INVENTION

The technical field of this invention is hoists for lifting, positioning and installing panels and other sheet material.

BACKGROUND OF THE INVENTION

In construction there is a need for an apparatus which is capable of lifting and positioning sheet or panel materials for installation. This is particularly true with panels of sheet rock or dry wall. Installation of panels also is required where rock lath or manufactured paneling is being installed. In most cases it is very difficult to accurately position and install a panel without assistance from another person.

The problem of properly installing panel materials has been recognized in the prior art. The following United States patents all show some type of apparatus for lifting and/or installing panel materials such as plasterboard or wallboard: U.S. Pat. No. 2,442,349 to Foster; U.S. Pat. No. 2,472,887 to Core; U.S. Pat. No. 2,815,251 to Stone; U.S. Pat. No. 2,969,220 to Spencer; U.S. Pat. No. 3,178,038 to Love; U.S. Pat. No. 3,221,900 to Love; U.S. Pat. No. 3,305,219 to Rhodes; U.S. Pat. No. 3,382,988 to O'Reilly; and U.S. Pat. No. 4,339,219 to Lay. None of these prior art apparatus show a hoist similar to the current invention. All suffer from the limitation of being relatively unportable and having a restricted height capability.

It is an object of this invention to provide a panel hoist which is capable of raising panels to relatively high positions and allowing accurate installation of the panel by a single workman.

It is another object of the invention to provide a panel hoist which is capable of being converted into a compact unit for ease of transportation.

It is a further object of the invention to provide a panel hoist which is reliable, easy to construct, and efficient in performance of its desired duties.

These and other objectives and advantages of the invention will be apparent from the description given herein.

BRIEF DESCRIPTION OF THE DRAWINGS

A preferred embodiment according to the invention is illustrated in the accompanying drawings, in which:

FIG. 2 is an enlarged longitudinal sectional view showing the internal mechanical workings of the panel hoist of FIG. 1, no panel supporting head is shown and portions have been removed;

FIG. 3 is an enlarged side elevational view of the mast assembly and base framework shown in collapsed form, no panel supporting head assembly is shown and portions have been removed;

DETAILED DESCRIPTION OF THE PREFERRED EMBODIMENTS

In compliance with the constitutional purpose of the Patent Laws "to promote the progress of science and useful arts" (Article 1, Section 8), applicant submits the following disclosure of the invention.

Figure 1:
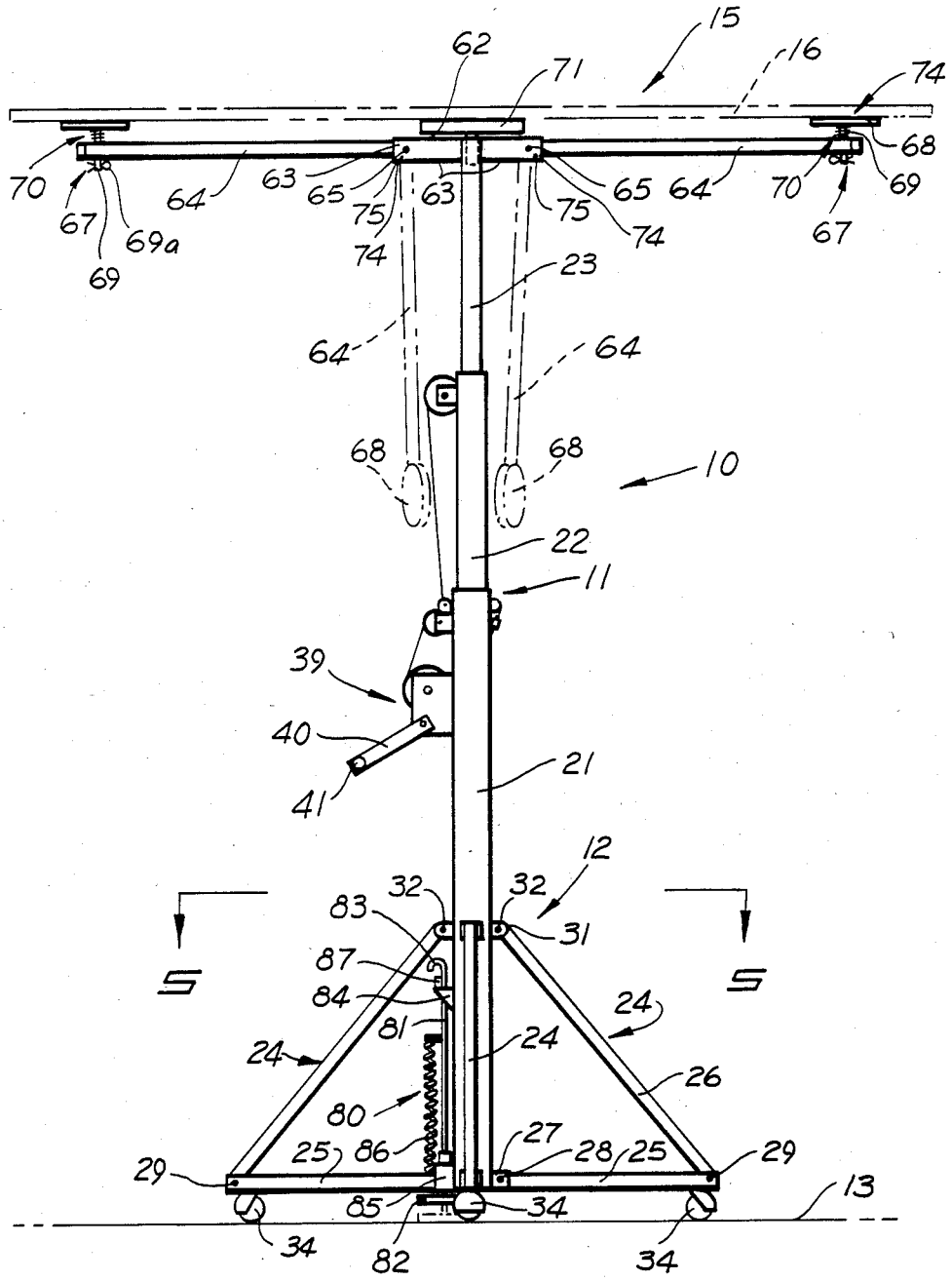
FIG. 1 is a side elevational view.

FIG. 1 shows a preferred embodiment of panel hoist 10 constructed according to this invention. Panel hoist 10 includes an upright mast assembly 11. Mast assembly 11 is held in an upright position by a base framework 12 which contacts a floor or other supporting surface 13. Panel hoist 10 also includes a head assembly such as horizontal head assembly 15. Horizontal head assembly 15 is shown supporting a panel 16 which is shown in phantom. Having generally described the major components of panel hoist 10, the discussion will now turn to a more detailed consideration of the various components and features of the invention.

Base framework 12 is connected to mast assembly 11 at a lower or main mast piece 21. Base framework 12 includes a plurality of legs 24 which are constructed with a bottom link 25 and an angled link 26. Bottom links 25 are pivotally connected at the bottom of main mast piece 21 using bottom brackets 27 and pivot pins 28. Angled links 26 are pivotally connected to bottom links 25 at pivots 29. The opposite ends of angled links 26 are removably connected to main mast piece 21 at a points above bottom brackets 27 using top brackets 31. Top brackets 31 are rigidly connected to main mast 21. Angled links 26 and brackets 31 are provided with apertures **26*a* and 31*a*, respectively, for receiving removable pins 32** therein.

Base framework 12 is preferably provided with casters 34 which allow the entire panel hoist to be accurately rolled into position during installation of panel 16.

Base framework 12 is constructed so as to allow the framework to be collapsed inwardly against the sides of main mast piece 21 for transport or storage. The collapsed mode of operation for base framework 12 is shown in FIG. 3. In the collapsed mode of operation, base framework legs 24 extend longitudinally along the outside of main mast piece 21. Bottom links 25 extend upwardly from pivots 28. Pivots 29 allow the bottom and angled links to both be extended in a line flat against the sides of the mast assembly. When collapsed, pivots 29 do not extend sufficiently high to reach upper brackets 32. Angled links 26 are positioned along the sides of main mast piece 21 and held inside the U-shaped upper brackets 32 using removable pins 32 which are received in apertures **31*a*. Removable pins 32 can advantageously include a large circular ring 32*a* which can extend over the outer ends of brackets 31 to secure the removable pins against inadvertent dislodgement. The collapsed mode of operation for base framework 12** greatly reduces the amount of space necessary to transport and store the panel hoist and does so in a manner which optimizes the compact arrangement of all parts.

Mast assembly 11 is preferably constructed using three mast pieces. The lower or main mast piece 21 is directly connected to base framework 12. A middle or secondary mast piece 22 is slidably held within the inside of the tubular main mast piece 21. A top or tertiary mast piece 23 is slidably held within the interior of the tubular secondary mast piece 22.

Mast assembly 11 is constructed so that the mast pieces telescope for extension and contraction to adjust the overall height of the panel hoist. The telescopic relationship between top mast piece 23, secondary mast piece 22 and main mast piece 21 allows a greater height extension for a given overall collapsed length of the telescopic mast assembly when compared to prior art two stage telescoping mast hoists.

FIG. 2 shows how the mast assembly 11 is constructed in greater detail for its telescopic operation. Main mast piece 21 is tubular in construction and provided with an elongated front slot 36 and an elongated rear slot 37. Slots 36 and 37 are provided so that a winch cable 38 can extend longitudinally along and through the walls of tubular main mast 21. Slots 36 and 37 preferably do not extend the full length of main mast piece 21, but instead are provided over longitudinal distances just sufficient to allow the easy working of winch cable 38.

A winch means 39 is connected to the outside of main mast piece 21 and is used to take up the length of winch cable 28. Winch means 39 preferably includes a crank arm 40 and handle 41 allowing the winch to be operated by hand in the typical fashion. Winch cable 38 extends from a winch spool 42 over a main mast pulley 43 and down along and through the rear slot 37. Winch cable 38 extends through a rear secondary mast aperture 45 and is arranged about the underside of a second mast sheave 47. Secondary mast sheave 47 is rotatably mounted near the bottom end of secondary mast piece 22. Winch cable 38 extends from sheave 47 outwardly through a front secondary mast aperture 46 and then extends logitudinally along and through main mast front slot 36. The distal end of winch cable 38 is fixed to a winch cable loop 49 near the top end of main mast piece 21. Secondary mast piece 22 moves upwardly and downwardly in response to changes in the available length of winch cable 38.

Secondary mast piece 22 has an attached secondry mast pully 51 which is mounted near the top end of the secondary mast piece. Secondary mast piece pulley 51 receives a top mast piece cable 52 thereover. Top mast piece cable 52 is connected at one end to main mast piece 21 using a bracket 53. The other end of top mast piece cable 52 is connected to the bottom end of top mast piece 23 at connection means **52*b*. As the secondary mast piece 22 is extended from the main mast piece, the distance between the bracket 53 and secondary mast pulley 51 increases and accordingly requires top mast cable 52 to play over pulley 51. This decreases the amount of cable available between secondary mast pulley 51 and connection means 52*b* at the bottom end of top mast piece 23, thereby extending the top mast piece 23 from the secondary mast piece 22**.

The top mast piece 23 is preferably a tubular member sized and shaped to be slidably received within secondary mast piece 22. Top mast piece 23 is provided with an elongated rear side slot 55 which allows the outer periphery of the secondary mast pulley 51 to extend thereinto. Slot 55 allows the top mast piece 22 to slide relative to the secondary mast pulley, even though the pulley is extending thereinto. Top mast piece 23 is preferably provided with a stop 56 which limits the extent to which the top mast piece can retract within secondary mast piece 22. Secondary mast piece 22 is prevented from retracting fully within main mast piece 21 by the presence of mounting bracket **51*a* used to support secondary mast pulley 51. Mounting bracket 51*a* stops against the main mast piece at the upper end thereof or in a small slot 200 (FIGS. 2 and 3**) cut at the upper end thereof.

Figure 4:
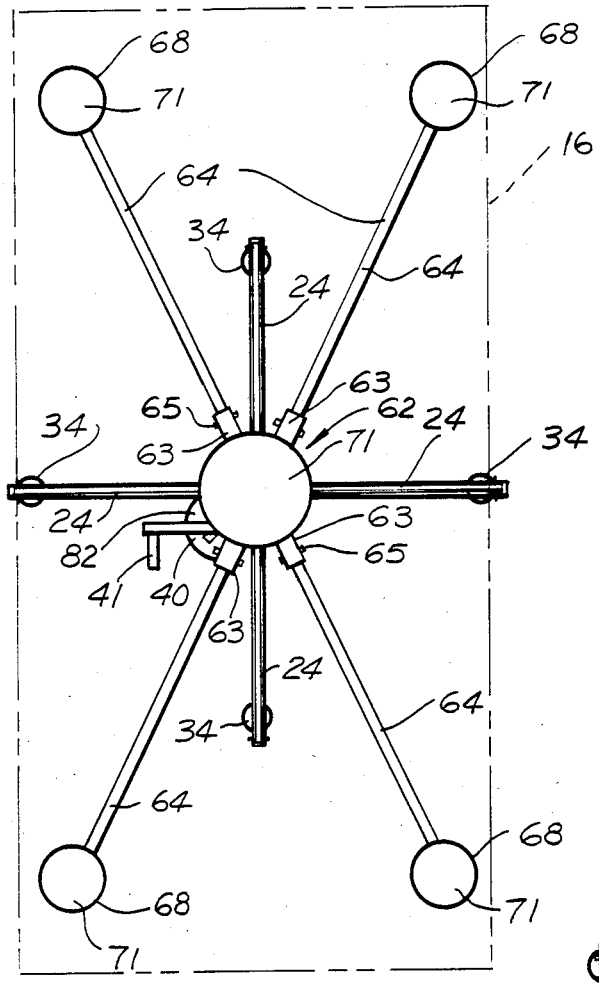
FIG. 4 is a top view of the panel hoist shown in FIG. 1.
Figure 5:
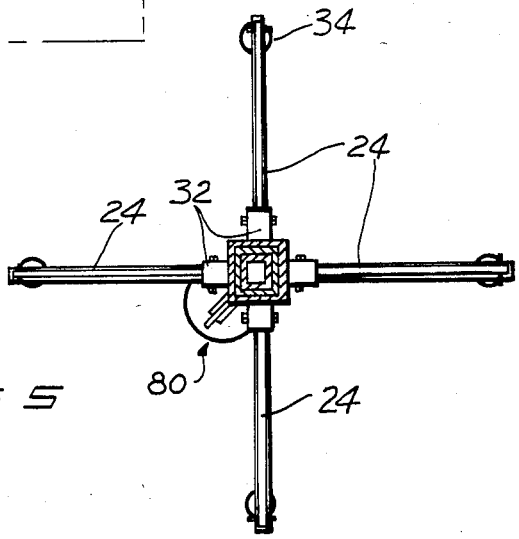
FIG. 5 is a cross-sectional view taken along line 5—5 of FIG. 1.

FIG. 1 shows a horizontal head assembly 15 which is used to support a panel 16 in approximately horizontal position above the top end of top mast piece 23. FIG. 4 shows the horizontal head assembly 15 in top view. Horizontal head assembly 15 includes a connection piece 62 which preferably fits within the open top end of the tubular top mast piece 23. Head connection piece 62 preferably includes four extension arm brackets 63. Connection arm brackets 63 are used to pivotally attach four extension arms 64 to head connection piece 62. Extension arms 64 are pivotally connected to connection brackets 63 at pivots 65.

Extension arms 64 are locked into the outreaching or extended positions using locking pins 74 which extend through apertures 75. Apertures 75 are formed in connection arm brackets 63 and can be positioned so that the locking pins 74 extend either beneath extension arm or through apertures formed in the extension arms (not shown).

Extension arms 64 are preferably provided with resilient mounts 67 at the distal ends thereof. Resilient mounts 67 can advantageously be constructed using a resilient mount disk 68 having a pin 69 rigidly connected thereto. A compression spring 70 is positioned over the pin 69 between the disk and the extension arm 64. A cotter pin or other key **69*a* can be used to prevent pin 69 from being forced from its receiving hole in extension arms 64. Resilient mount disks 68 are preferably provided with a resilient top covering or pad 71 which prevents the panel 16 from being damaged when placed thereon or moved about. Resilient pads 71 are preferably a thin nylon pad. Resilient pads 71 can also be provided at the top of connection piece 62 to provide support for the middle of panel 16**.

FIG. 1 shows in phantom that extension arms 64 can be rotated downwardly adjacent to mast assembly 11 for compactness during storage or transit. FIG. 4 shows that the extension arms 64 are offset from the base framework legs 24, thereby allowing the extension arms and legs to be interpositioned along the sides of main mast piece 21. Extension arms 64 are moved into the collapsed position shown in phantom in FIG. 1 by removing locking pins 74 from apertures 75 in extension arm brackets 63 and then folding downwardly.

The panel hoist of this invention also preferably includes a brake means 80 which can advantageously be provided near the bottom end of main mast piece 21. Brake means 80 can advantageously include a brake stem 81 having a contact pad 82 at the lower end and a finger hook 83 at the upper end. Brake stem 81 extends through an upper bracket 84 and a lower bracket 85 both of which are attached to main mast piece 21. Brake stem 81 is slidably held within or by upper and lower brackets 84 and 85 for up and down motion therein. A biasing means such as spring 86 is advantageously included to bias the contact pad 82 into contact with a floor or other supporting surface.

Brake stem 81 is preferably provided with a locking means for locking the brake stem in a retracted position wherein the contact pad is moved upwardly and out of contact with the supporting surface. Suitable locking means can include a projection 87 on the brake stem 81 at a point adjacent to upper bracket 84. Upper bracket 84 can be provided with a suitably shaped aperture which allows the projection 87 to be moved through the bracket aperture and positioned so as to retain the brake stem in an upward position shown in FIG. 1. The brake stem 81 can be released by moving the brake stem so that the projection means 87 will drop down through the aperture formed in upper bracket 84 thereby allowing the contact pad 82 to contact and supporting surface 13 as shown in phantom in FIG. 1.

Figure 6:
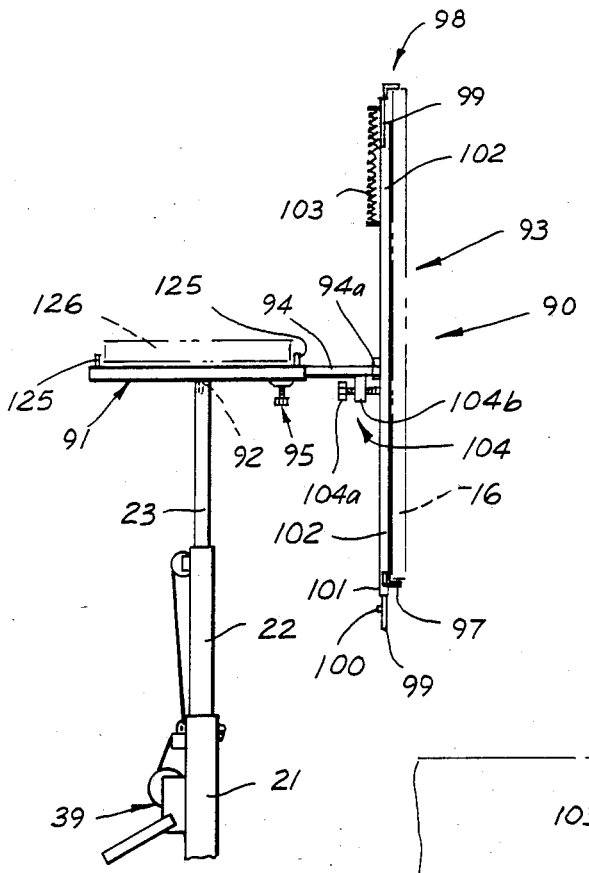
FIG. 6 is a partial side elevational view of the mast assembly shown in FIG. 1 fitted with a vertical head assembly.
Figure 7:
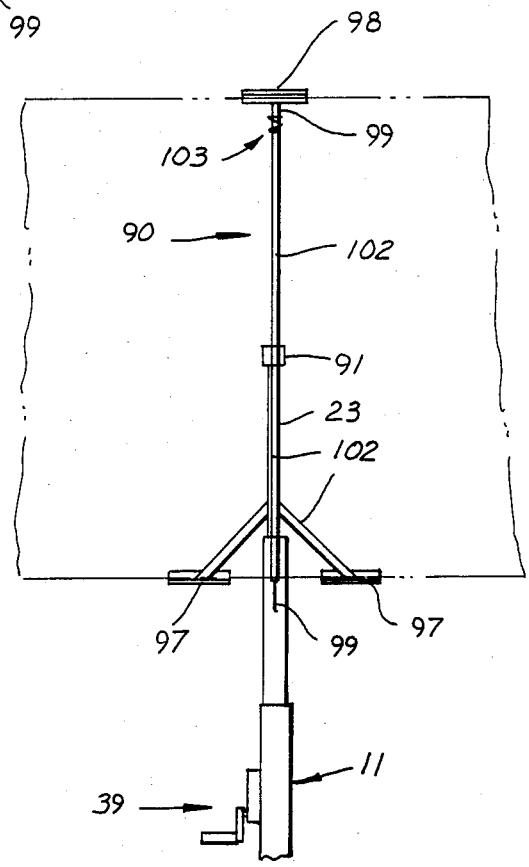
FIG. 7 is a partial front elevational view of the panel hoist of FIG. 6.

The preferred form of this invention also includes a vertical head assembly 90 for holding panel 16 in an upright position (see FIGS. 6 and 7). Vertical head assembly 90 is used to position and install a panel onto a vertical or upright structure. Vertical head assembly 90 includes a T-head piece 91 which is provided with a mast extension 92 which extends downwardly into the hollow upper end of top mast piece 23. T-head piece 91 is preferably made from a hollow tubular material so that a vertical side assembly 93 can be mounted by inserting an extension 94 therein. Extension 94 can be fixed in the T-head piece using a locking means such as bolt 95.

The vertical side assembly 93 also includes a side assembly lower bracket frame 102 which is pivotally attached to extension 94 at pivot 94*a*. An upper bracket support stem 99 is slidably held within lower brake frame 102 for up and down motion therein. Lower brackets 97 are mounted upon the lower bracket support frame 102. At least one upper bracket 98 is mounted at the upper end of upper bracket support stem 99. A panel 16 is held between upper and lower brackets 98 and 97. A biasing means such as spring 103 is used to bias upper bracket 98 and upper bracket support stem 99 downwardly. A locking means such as tang 100 is provided to lock support stem 99 in an upward position so that a panel can be installed in the vertical head assembly 90. Tang 100 locks the stem in an upward position when the tang catches in an aperture 101 formed in the support frame 102.

The vertical orientation of frame 102 and stem 99 is preferably adjustable using an angle adjustment means 104 such as a bolt 104*a* and a threaded bracket 104*b* which allows the bolt to force the frame 102 about the pivot connection 94*a*.

Vertical head assembly 90 is also advantageously provided with plank restraining brackets 125 which can be used to provide lateral restraint for a plank 126 shown in phantom. Planks can be positioned on two of the hoists 10 or upon a hoist and other scaffold means (not shown).

The manner of using the invention will now be considered more fully. Assuming that the panel hoist is in a collapsed or knocked down condition such as partially shown in FIG. 3, then it is first necessary to begin to extend the base framework 12 so that it can support the mast assembly 11 in an upright position with stability. Base framework 12 is extended by first removing the removable pins 32 from the base framework upper brackets 31. Base framework legs 24 can then be rotated outwardly about pivot pins 28. Angled links 26 are then folded back inwardly so that their upper ends are positioned with angled link receiving holes 26*a* aligned with receiving holes 31*a* in the base framework upper brackets 31. Removable locking pins 32 are then inserted through apertures 31*a* and 26*a* thereby locking the base framework legs 24 in a triangular or braced relationship at the sides of main mast piece 21. In this position, the casters 34 are in contact with the ground and suspend the bottom of main mast piece 21 above the floor.

Either horizontal head assembly 15 or vertical head assembly 90 is installed in the upper end of top mast piece 23. When horizontal head assembly 15 is being used, extension arms 64 are extended outwardly by rotating them about pivots 65. Locking pins 74 are then inserted through apertures 75 in extension arm brackets 63 in order to lock the extension arms outwardly in approximately horizontal positions. The horizontal head assembly is then ready to receive a panel 16 thereon.

A panel 16 is placed thereon supported by resilient mounts 67. The hoist is then positioned by rolling into place and the mast assembly is raised using winch means 39. The panel can be raised upwardly into position and in direct, forced contact with the structure on which the panel is being installed. The workman then nails, screws or otherwise attaches the panel overhead and without requiring aid from a second person.

When vertical head assembly 90 is being used, the T-head piece 91 is inserted into the upper end of top mast piece 23 so that the mast extension 92 extends downwardly into the end of the tubular top mast piece. The vertical side assembly 93 can then be inserted into the end of the tubular T-head pieces 91 using the side assembly extension 94 which is sized to be received within the tubular T-head piece. Extension 94 is locked inside the T-head piece using a locking means 95.

Prior to installing the panels and side assembly 93 it is necessary to lock the upper bracket 98 in an upward position. This is done by moving the upper bracket support stem upwardly until tang 100 can be received within aperture 101 formed in the side assembly lower bracket frame 102. Once the upper bracket is held upwardly, then it is possible raise and lift a panel 16 by hand into position and rest it upon lower brackets 97. Once the panel 16 has been properly positioned, then the upper bracket support stem can be released by moving it so that tang 100 is released from aperture 101. Stem 99 then slides downwardly until the upper bracket 98 contacts the top of panel 16 because of the biasing force of spring 103.

The panel hoist 10 is then ready for installing the panel 16 along a vertical or otherwise upright surface. Brake means 80 is released by pulling brake stem 81 upwardly. Panel hoist 10 is then rolled into position and if necessary the side assembly vertical adjustment means 104 is moved so that the proper orientation of panel 16 is obtained for accurate positioning of panel 16 next to the structure upon which it is being installed. Brake means 80 can be reapplied to prevent rolling of panel hoist 10 when the panel 16 has been properly positioned for installation. The carpenter or other user then nails, screws or otherwise affixes the panel 16 into place and goes on to similar operations for additional panels.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A hoist for raising and positioning panels, comprising:

a tubular main mast piece having at least one side aperture formed therein, and a bottom end and top end;

a tubular secondary mast piece slidably received within the tubular main mast piece; the secondary mast piece having a bottom end and a top end; the secondary mast piece having at least one secondary mast sheave rotatably mounted near the bottom end;

a top mast piece slidably received within the tubular secondary mast piece; the top mast piece having a top end and a bottom end;

at least one secondary mast pulley mounted near the top end of the secondary mast; the secondary mast pulley having a top mast cable extending thereover which is connected to the main mast piece and arranged to support the top mast;

a base framework connected to the main mast piece for supporting the mast pieces in an upright position upon a supporting surface; the base framework including casters for allowing the hoist to be rollably positioned upon a supporting surface; the base framework also being adjustable between extended positions wherein the casters are extended outwardly and a contracted position wherein the base framework is collapsed against the main mast piece for compact portability;

a head assembly detachably connected to the top mast piece and having extension arms adjustable between extended positions wherein the extension arms extend outwardly and collapsed positions wherein the extension arms extend downwardly along the mast pieces; and winch means mounted upon the main mast piece, and having a winch cable which extends beneath the secondary mast sheave and upwardly to the opposed side of the main mast piece, to lift the secondary and top mast pieces as the winch means takes up the winch cable.

2. The hoist of claim 1 further comprising a vertical head assembly for releasably holding panels in a vertical position; the vertical head assembly being connectible to the top mast piece in lieu of the head assembly; the vertical head assembly including at lease one lower support bracket mounted upon a lower support bracket frame and at least one upper support bracket which is movably mounted to the vertical head assembly and biased toward the lower support brackets to hold a panel therebetween.

3. The hoist of claim 2 wherein the vertical head assembly further comprises angle adjustment means for adjusting the angular orientation of the upper and lower support brackets.

4. The hoist of claim 2 wherein the vertical head assembly is constructed with a T-head piece which is provided with plank restraining means whereby a plank can be supported on the T-head piece and restrained by the plank restraining means.

5. The hoist of claim 1 wherein the extension arms are provided with resilient panel supports mounted at distal ends thereof.

6. The hoist of claim 1 wherein the tubular main mast is provided with side slots formed therein.

7. The hoist of claim 1 wherein said base framework includes a plurality of framework legs having bottom links pivotally connected to the main mast piece, and angled links pivotally and detachably connected to the main mast and pivotally connected to said bottom links.

8. The hoist of claim 1 wherein:

the extension arms are provided with resilient panel supports mounted at distal ends thereof;

the tubular main mast is provided with side slots formed therein; and the base framework includes a plurality of framework legs having bottom links pivotally connected to the main mast piece, and angled links pivotally and detachably connected to the main mast and pivotally connected to said bottom links.

* * * * *